US009574810B1

(12) United States Patent
West

(10) Patent No.: US 9,574,810 B1
(45) Date of Patent: Feb. 21, 2017

(54) OPTIMIZING ENERGY EFFICIENCY RATIO FEEDBACK CONTROL FOR DIRECT EXPANSION AIR-CONDITIONERS AND HEAT PUMPS

(71) Applicant: Michael Kenneth West, Melbourne, FL (US)

(72) Inventor: Michael Kenneth West, Melbourne, FL (US)

(73) Assignee: Advantek Consulting Engineering, Inc., Melbourne, FL (US)

( * ) Notice: Subject to any disclaimer, the term of this patent is extended or adjusted under 35 U.S.C. 154(b) by 169 days.

(21) Appl. No.: 14/162,424

(22) Filed: Jan. 23, 2014

Related U.S. Application Data

(60) Provisional application No. 61/756,017, filed on Jan. 24, 2013.

(51) Int. Cl.
*F25B 49/02* (2006.01)

(52) U.S. Cl.
CPC ..... *F25B 49/02* (2013.01); *F25B 2500/18* (2013.01)

(58) Field of Classification Search
CPC ..... F25B 2600/2513; F25B 2500/19; F25B 2700/21151; F25B 49/02; F25B 13/00; G01R 19/2513; G01F 1/8436; G01F 25/0007; G01F 115/024
USPC ..... 702/182; 62/190, 203
See application file for complete search history.

(56) References Cited

U.S. PATENT DOCUMENTS 4,186,563 A 2/1980 Schulze, Sr.
4,325,223 A 4/1982 Cantley
4,327,559 A 5/1982 Spethmann
4,420,947 A 12/1983 Yoshino
4,432,232 A 2/1984 Brantley et al.
4,510,576 A 4/1985 MacArthur et al.
4,611,470 A 9/1986 Enstrom
5,623,834 A 4/1997 Bahel et al.
5,735,134 A 4/1998 Liu et al.
5,979,167 A * 11/1999 Kochavi ..... F24F 3/044 62/186
6,293,108 B1 9/2001 Cho et al.
6,701,725 B2 3/2004 Rossi et al.
7,000,413 B2 2/2006 Chen et al.
7,114,343 B2 10/2006 Kates
7,200,524 B2 4/2007 Kang et al.
7,261,762 B2 8/2007 Kang et al.
7,472,557 B2 1/2009 Kang et al.
(Continued)

OTHER PUBLICATIONS

U.S. Patent and Trademark Office's Non-Final Office Action dated Aug. 26, 2015 cited in related U.S. Appl. No. 13/162,387 (17 pages).

*Primary Examiner* — William Gilbert
(74) *Attorney, Agent, or Firm* — Kelly G. Swartz; Widerman Malek, PL

(57) ABSTRACT

Measured EER and COP are affected by the load under which an air conditioning, refrigeration or heating system is running; the load is a function of the evaporating and condensing temperatures. The invention makes adjustments for the purpose of maximizing measured EER and COP in a feedback loop utilized to optimize cooling or heating capacity relative to power consumed. The maximum EER is continuously achieved by incrementally adjusting each operating parameter to realize an incremental increase in EER, even as conditions such as ambient temperature are changing.

8 Claims, 5 Drawing Sheets

(56) References Cited

U.S. PATENT DOCUMENTS

| | | | | |
|---|---|---|---|---|
| 7,500,368 | B2 | 3/2009 | Mowris | |
| 8,056,348 | B2 | 11/2011 | Murakami et al. | |
| 8,272,227 | B2 | 9/2012 | McMasters et al. | |
| 8,583,384 | B2 | 11/2013 | Mowris | |
| 9,261,542 | B1 * | 2/2016 | West | G01R 19/2513 |
| 2003/0167792 | A1 | 9/2003 | Cho et al. | |
| 2006/0032245 | A1 * | 2/2006 | Kates | F24F 3/1603 62/129 |
| 2010/0153057 | A1 | 6/2010 | Bersch et al. | |
| 2013/0186119 | A1 | 7/2013 | Burns et al. | |
| 2015/0177109 | A1 * | 6/2015 | Lockhart | G01K 13/00 702/182 |
| 2016/0061495 | A1 * | 3/2016 | Sillato | F25B 13/00 62/498 |

* cited by examiner

OPTIMIZING ENERGY EFFICIENCY RATIO FEEDBACK CONTROL FOR DIRECT EXPANSION AIR-CONDITIONERS AND HEAT PUMPS

CROSS REFERENCE TO RELATED APPLICATIONS

The present application claims the benefit under any relevant U.S. statute to U.S. Provisional Application No. 61/756,017 filed Jan. 24, 2013, titled EER METER AND OPTIMIZING FEEDBACK CONTROL FOR DX AIR-CONDITIONERS.

FIELD OF THE INVENTION

The present invention relates generally to heating, ventilation, air conditioning, and refrigeration (HVAC&R) equipment. It specifically addresses optimization of the cooling and/or heating capacity relative to the power usage, to continuously maximize the energy efficiency ratio and the coefficient of performance, and the cooling or heating capacity relative to the power consumption, under actual operating conditions.

BACKGROUND OF THE INVENTION

The thermodynamic method used in nearly all air conditioners, refrigerators and heat pumps is the vapor compression cycle also called the refrigeration cycle. The basic cycle uses four primary components: a compressor, a condenser, an expansion device, and an evaporator; some systems may use additional components such as a receiver, additional heat exchangers, two or more compressors, and/or an accumulator and other specialized components such as a liquid-vapor separator or a vortex separator and/or a surge tank or refrigerant reservoir or vessel. The four primary components are piped in series to form a closed loop system that carries out the changes in temperature, pressure and state of the working fluid refrigerant that form the basic vapor compression cycle. Furthermore, within air conditioners, refrigerators, and heat pumps outside of the refrigeration cycle there are typically ancillary components that move the desired heat transfer medium, such as the blowing of air or of flowing of water that is to be cooled or heated, across the primary heat exchangers being the condenser coil and the evaporator coil. In addition there is typically a control circuit that energizes and de-energizes the driven components including the compressor and such as fan motors, pump motors, damper actuators, and valves accordingly to meet a desired temperature, ventilation and/or humidity or other set points and operating parameters.

The present invention makes adjustments to an air conditioning, refrigerating or heating system for the purpose of maximizing measured EER, COP and/or IEER in a feedback loop utilized to optimize cooling or heating capacity relative to power consumed. The efficiency of vapor compression cycles is numerically described by an energy efficiency ratio (EER) and/or a coefficient of performance (COP). The EER generally refers to the air conditioning, refrigerating or heating system and is the ratio of the heat absorbed by the evaporator cooling coil over the input power to the equipment, or conversely for heat pumps, the rate of heat rejected by the condenser heating coil over the input power to the equipment. EER is defined as the ratio of cooling or heating provided to electric power consumed, in units of Btu/hr per Watt. EER varies greatly with cooling load, refrigerant level and airflow, among other factors. The COP generally refers to the thermodynamic cycle and is defined as the ratio of the heat absorption rate from the evaporator over the rate of input work provided to the cycle, or conversely for heat pumps, the rate of heat rejection by the condenser over the rate of input work provided to the cycle. COP is a unitless numerical ratio. In addition, there is a standard weighted average of EER at four conditions known as the integrated energy efficiency ratio (IEER), which relates to an estimation of the energy efficiency over conditions experienced during a cooling season. Also, there is the seasonal energy efficiency ration (SEER) that is used instead of the IEER for smaller air conditioning units. Either effect of lowering capacity or increasing power manifest in reduced energy efficiency and a reduced EER, COP and IEER while making adjustments to increase capacity without increasing power, or reducing power without decreasing capacity, or both increasing capacity and reducing power will manifest in an increased EER, COP and IEER.

The actual operating EER or COP is key to maximizing efficiency, because it provides an absolute, realistic and continuous assessment of operational efficiency with feedback so a harmonized adjustment of operating parameters can be conducted. Measuring the EER, COP and IEER of systems based on the vapor compression cycle is difficult, more so while operating in a field environment rather than a test laboratory. An accurate heat absorption or heat rejection measurement for these systems is quite complex and requires measurement of the mass flow rate of fluid through the heat exchanger along with enthalpies entering and leaving the heat exchanger; a detailed description of EER and COP measurement is provided for a related invention that is disclosed separately.

The measured EER and COP are affected by the load under which the air conditioning, refrigeration or heating system is running; the load is a function of the evaporating and condensing temperatures. An increase in evaporating temperature will raise the measured EER and COP, as will a decrease in condensing temperature; as can be predicted by the thermodynamic cycle parameters. Likewise, lower evaporating temperature will reduce the measured EER and COP, as will higher condensing temperature.

The prior art does not make adjustments to the operating parameters or the components of the air-conditioning, refrigeration or heat pump system according to the measured EER or COP, neither to increase the evaporating temperature or decrease the condensing temperature, nor to adjust other parameters that effect the refrigerant subcooling or superheat, or the refrigerant composition in the case of systems using mixtures of two or more refrigerants, or of the refrigerant mass flow rate, or the refrigerant pressures, to maximize the EER or COP. An energy management system for refrigeration systems by Cantley (U.S. Pat. No. 4,325,223) relies on inference of energy efficiency rather than a direct measurement; the inference is based on relative comparison of compressor power data and other system parameters stored in memory; and the system does not make control adjustments according to the system energy efficiency ratio, rather it controls evaporative cooling. An invention by Spethmann (U.S. Pat. No. 4,327,559) applies to chilled water systems rather than direct expansion (DX) systems; and simply balances the trade-off between colder chilled water versus faster fan airflow using ratio relays. A method by Enstrom (U.S. Pat. No. 4,611,470) also applies only to chilled water systems; the described method for performance control of heat pumps and refrigeration equipment depends on the chilled water temperature and does not mention refrigerant temperature or pressure measurements. The purpose of an invention by Bahel, et al. (U.S. Pat. No. 5,623,834) is diagnostics and fault correction, rather than energy efficiency optimization; and only the fan speed and thermostatic expansion valve are controlled based on relative comparison of two temperatures and the thermal load calculated via a thermostat. Two patents by Cho, et. Al (U.S. Pat. No. 6,293,108) disclose methods for separating components of refrigerant mixtures to increase energy efficiency or capacity, however, energy efficiency ratio is neither measured nor is it a basis for adjustments. Chen, et al. (U.S. Pat. No. 7,000,413) discloses control of a refrigeration system to optimize coefficient of performance, yet there is no detailed description of how COP is calculated. Adjustment is carried out to achieve a reference COP stored in memory rather than being an optimization process. Also, the primary application of Chen, et al. is transcritical systems using carbon dioxide refrigerant; an embodiment for measurement of the refrigerant flow rate is not described; and only water flow rate and the expansion valve are adjusted. Automatic refrigerant charge adjustment methods by Kang, et al. (U.S. Pat. No. 7,472,557), Murakami, et al. (U.S. Pat. No. 8,056,348), and McMasters, et al. (U.S. Pat. No. 8,272,227) simply adjust charge to match published charging tables or reference temperature or pressure values, which are not optimized values, rather they are non-optimal compromise values that work under a wide range of operating conditions and load.

SUMMARY OF THE INVENTION

The controller continuously makes adjustments to any or all of the operating parameters of an air-conditioning, refrigeration or heat pump system to maximize the measured EER and COP. Operating parameter values, such as motor speeds, temperature set points, or actuator positions, are continuously optimized as conditions change, such as changes in ambient temperature, and cooling or heating load, so that efficiency is as high as possible within the physical constraints of the system and the operating conditions. The invention utilizes a genuine and accurate measurement of the EER of the DX cooling, refrigeration, or heating unit, proportional to standard units of cooling capacity per unit of energy use (Btuh per Watt, or MBH per kW) and/or COP (unitless).

The preferred embodiment is a system-mounted control device that can be installed as an enhancement of or alternative to standard air conditioner, refrigerator and heat pump system controllers. An alternative embodiment is an embedded control sequence program in a building automation system (BAS) or energy management system (EMS). Accurate, direct, standard EER and COP measurements are clearly displayed by the controller, along with diagnostic messages identifying out of range values if so desired, allowing a technician to immediately appraise the operating efficiency of the system. EER and COP measurements are based on signals from a plurality of sensors. Sensor data is utilized to calculate the difference between the heat content of the refrigerant at the entrance and exit of the cooling coil (evaporator) or of the heating coil (condenser), and the system or compressor power demand. EER is calculated as the rate of heat transport at the evaporator for cooling or at the condenser for heating divided by the real power input to the system and is provided in units of Btuh per Watt on a display and as an analog or digital signal that is utilized in a control loop. In a similar manner, COP is calculated as the rate of heat transport divided by the real power input to the compressor and provided as a unitless (Watts per Watt) display and as an analog or digital signal. The cooling or the heating being delivered and the power consumed can also be displayed or transmitted by an analog or digital signal, as can any of the other measured, stored, intermediate, or calculated parameters, if desired.

The EER measurement is continually calculated by a microprocessor in a control loop at pre-defined time intervals while operating parameters are iteratively adjusted by changing output values. The adjustment direction, increase or decrease, and relative magnitude, large or small, is first calculated according to measured conditions and a log of previous values stored in memory. Then, with each large or small, increase or decrease, iteration of operating parameter change, the EER measurement after the system has restabilized is compared with the previous EER measurement, and the resulting change in EER is evaluated as either positive, not significant, or negative. A positive change in EER results in iteration of the next operating parameter, and a negative change in EER results in re-adjustment of the parameter. After a pre-defined number of iterations, or if the change in EER is less than a pre-defined convergence value, the next operating parameter is adjusted. The iteration sequence is continued until all operating parameters have been adjusted to achieve the maximum EER, and the control loop repeats with the first operating parameter. In this way, the maximum EER is continuously achieved by incrementally adjusting each operating parameter to realize an incremental increase in EER, even as conditions such as ambient temperature are changing.

BRIEF DESCRIPTION OF THE DRAWINGS

The accompanying drawings, which are incorporated in, and form a part of the specification, illustrate one preferred embodiment of the present invention and together with the description serve to explain the principles of the invention. The invention is shown purely by way of example with reference to the preferred embodiment and the drawings. The invention is not limited to the precise arrangements and instrumentalities shown in the document.

In the drawings.

DETAILED DESCRIPTION OF THE PREFERRED EMBODIMENT

Figure 1:
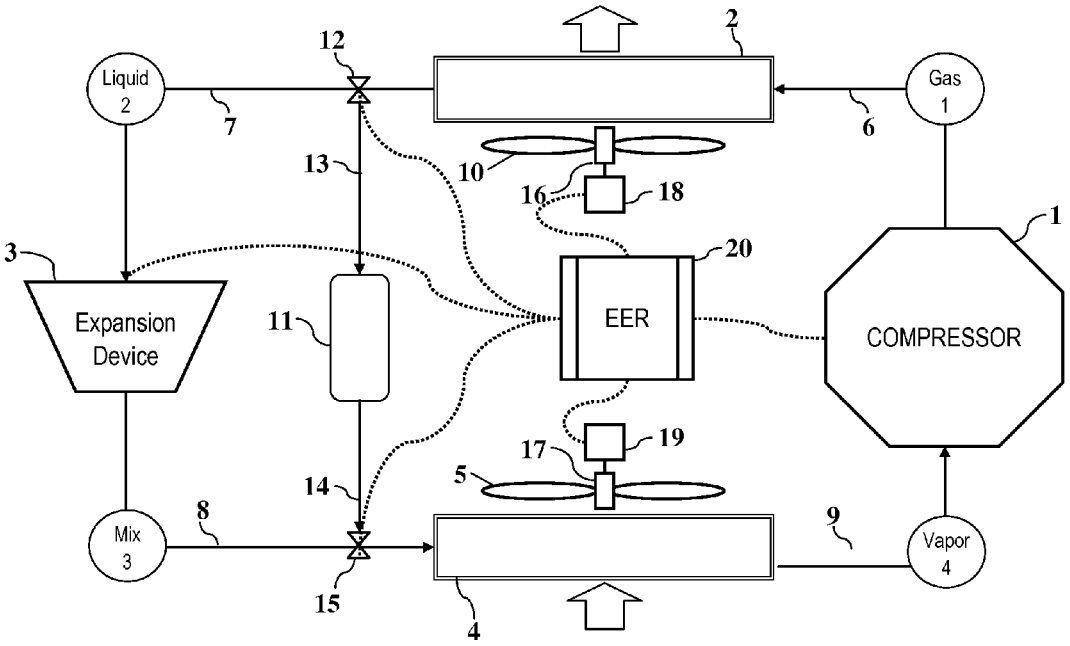
FIG. 1 is a schematic representation of an air conditioner, refrigerator or heat pump showing the connections from the output of the EER controller to the various components that are controlled to adjust the system operating parameters.
Figure 2:
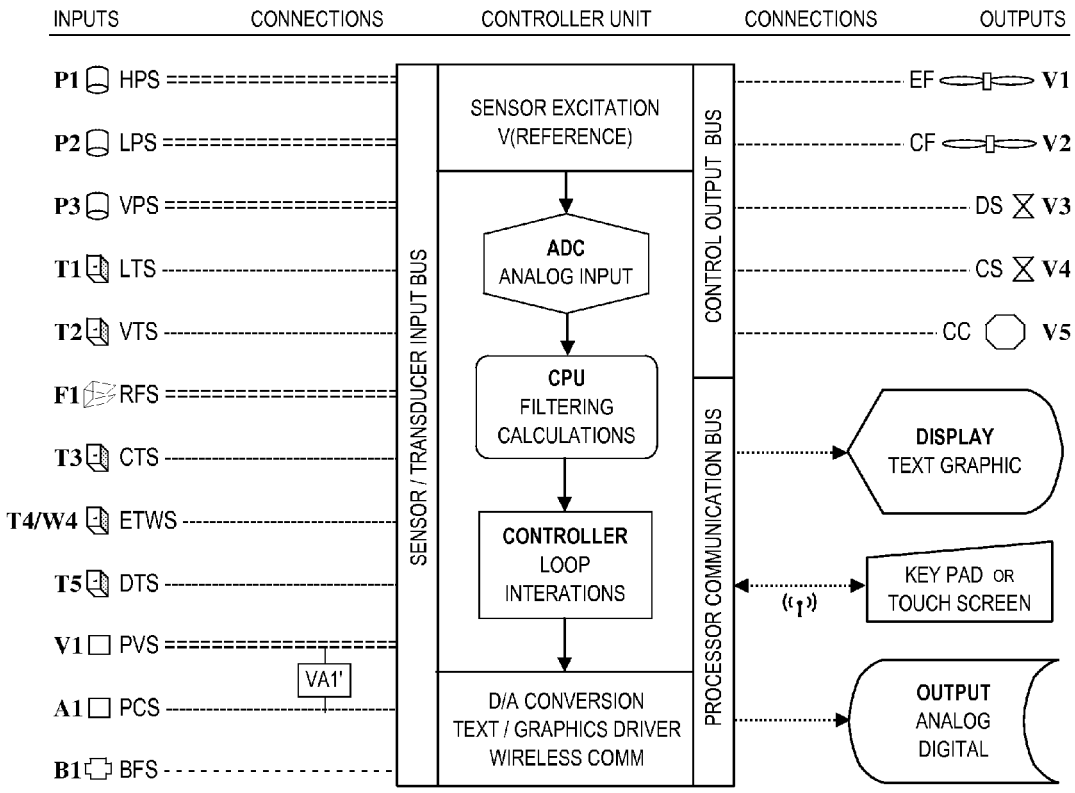
FIG. 2 is a block diagram showing the input sensor signals; the signal pathways between the sensors, the controller unit, the operating parameter outputs, and the display; the output signals; and the signal output display and connections.

A schematic representation of an air conditioner, refrigerator or heat pump showing the connections from the output of the EER controller to components that are controlled to adjust system operating parameters is shown in FIG. 1. Controller 20 generates voltage output signals proportional to operating parameter settings that maximize the energy efficiency ratio and coefficient of performance of the system as load and operating conditions vary. Voltage output signal V1 as shown in controller detail block diagram FIG. 2 is connected to evaporator fan motor speed control 19 shown in FIG. 1, which is a variable frequency drive or other motor speed control, as would be known to one skilled in the art, that can vary the speed of evaporator fan motor 17 driving evaporator fan 5. Voltage output signal V2 as shown in controller detail block diagram FIG. 2 is connected to condenser fan motor speed control 18 shown in FIG. 1, which is an electrically commutated motor speed control or other motor speed control, as would be known to one skilled in the art, that can vary the speed of condenser fan motor 16 driving condenser fan 10. Voltage output signals V3 and V4 shown in controller detail block diagram FIG. 2 are connected to refrigerant solenoid valves 12 and 15, respectively, which allow refrigerant to flow into our out of, respectively, vessel 11. Voltage signal V5 shown in controller detail block diagram FIG. 2 is connected to compressor 1 to vary the operation of the compressor, as would be known to one skilled in the art. The controller can operate with some or all of the outputs as illustrated in the preferred embodiment, or other or additional outputs that vary one or more operating parameters of the air conditioner, refrigerator or heat pump illustrated in FIG. 1 by the output connection to expansion device 3.

A block diagram showing the input sensor signals; the signal pathways between the sensors, the controller unit, the operating parameter outputs, and the display; the output signals; and the signal output display and connections is shown in FIG. 2. Eleven sensors and one optional sensor are arranged vertically along the controller input bus; their functions and connections are as follows. Transducer T4W4 is the evaporator air inlet temperature and humidity sensor (ETWS). Signals from transducer T4W4 are hardwired to an analog input when attached to a packaged air-conditioner, refrigerator or heat pump, or via a 2.4 GHz IEEE 802.15.4 RF wireless transmission or other wireless transmission as would be known to one skilled in the art, to the controller unit input when the transducer must be remotely positioned some distance away in the air handling unit of a split system. T4 is an RTD type element concurrent with element W4 thin-film capacitor, though it can be another type of element responsive to air relative humidity as would be known to one skilled in the art, and is housed together with circuitry requiring an excitation voltage to produce two 0-5 VDC scalable signals, one proportional to temperature and the other to humidity. All other sensors except T4W4 are normally positioned on the outdoor section of a split system and are hardwired or plugged into the controller unit. External flow sensor F1 is the refrigerant flow thermal sensor (RFS), which introduces a small quantity heat into the flow stream and measures the heat dissipation using two RTD temperature elements as would be known to one skilled in the art. An ultrasonic flow sensor, or a Doppler transit-time sensor or other sensor responsive to refrigerant mass or volume flow rate or velocity as would be known to one skilled in the art, or an intrusive sensor such as a turbine, vortex, magnetic or other sensor type as would be known to one skilled in the art can be used for F1. Depending on the flow rate and heat dissipation, F1 can operate in constant temperature differential mode, or, if conditions are such that a sufficient temperature differential cannot be maintained the mode is switched to constant current. Bubble fraction sensor B1 is optional, and if used, signals a 0-5 VDC output proportional to the sensed volume fraction of vapor in the liquid, as would be known to one skilled in the art. V1 is the power voltage sensor (PVS) directly attached to a line and the neutral or ground power phases conductors if the equipment is single-phase, and two line power phases if the equipment is three-phase or other voltage sensor type as would be known to one skilled in the art. A1 is the power current sensor (PCS); a current probe attached around an insulated line power phase conductor, or other sensor type as would be known to one skilled in the art, which senses current and transforms it by a 1000:1 ratio into a low current milli-Amp signal for input to the controller unit. Sensors V1 and A1 are connected directly to the controller input bus in the preferred embodiment, alternatively connected to power transducer VA1' having a 0-5 VDC output signal proportional to power, as would be known to one skilled in the art. Sensors T1, T2, T3 and T5 are type-K chromel-alumel thermocouples with 0.0 mV reference output at 0 Celsius and 4.096 mV at 100 Celsius, alternatively, resistance temperature detectors (RTD) or other sensors responding to changes in temperature as would be known to one skilled in the art can also be used; these are the liquid temperature sensor LTS, the vapor temperature sensor VTS, the condenser air inlet temperature sensor CTS, and the unit discharge air temperature sensor DTS. Signal from the thermocouple are transmitted to the analog thermocouple inputs via chromel-alumel insulated conductors, where an IC-compensated thermocouple input circuit, or other type of circuit as would be known to one skilled in the art, precisely transduces temperature from mV to ±0.25° C. as a 0-5 VDC scalable signal.

Excitation voltage for transducers P1, P2 and P3, which have micro-electric mechanical system (MEMS) strain-gauge sensing elements that are chemically compatible with refrigerants and refrigerant oils, and for transducers T4W4, F1 and B1, is provided by the control unit. Alternatively, other types of pressure sensors and transducers can be used as would be known to one skilled in the art. In the control unit, conditioned 0-5 VDC signals from the sensors/transducers are converted from analog form to digital form via a general purpose 16-bit multi-channel analog to digital convertor (ADC), or other type of convertor as would be known to one skilled in the art, with unipolar single-ended inputs with an external reference voltage, mounted on a printed circuit board (PCB) comprising a bus header, a field header, and digital logic circuitry with an octal 16-bit ADC; where the field header connects to the signals and the bus header interfaces to the central processing unit (CPU). The ADC sequentially converts each analog sensor signal from the native zero to reference voltage DC range to a binary value=V(sensor)/V(reference)*65536, to support mathematical manipulation by drivers and program code executed by the CPU.

The CPU package of the preferred embodiment consists of either a 25 MHz Freescale MC9S12A512 16-bit flash microprocessor, or a 16 MHz Motorola 68HC11F1 microprocessor, 1 MB Flash and 512K RAM and 320 bytes of EEPROM, with connections via a synchronous SPI serial interface and dual RS232/485 ports; alternatively other architecture microprocessors with various flash, RAM and/or EEPROM configurations be utilized to execute standard C or other program code language as would be known to one skilled in the art. The CPU accepts user input via a keypad for data entry and display selection as needed, or alternatively, from an IEEE 802.11 b/g touch screen device, or other wireless protocol as would be known to one skilled in the art. The microprocessor executes the ADC and DAC drivers and compiled ANSI-standard C program code that filters out-of-range values, calculates the EER and COP, and executes the control loop according to the flowchart in FIG. 5. Output values from the CPU are converted to analog signals by a 12-bit multi-channel digital to analog convertor (DAC), as would be known to one skilled in the art. Output signals EF and CF are 0-10 VDC proportional to the numerical setpoints of the speed of the evaporator fan 5 variable frequency drive and condenser fan 10 electronically commutated motor, or other motor speed control which responds to an input signal to achieve a desired motor speed as would be known to one skilled in the art. Output signals DS and CS are two-state 0 VDC or 5 VDC connected either directly, or indirectly via a relay as would be known to one skilled in the art, to solenoids actuating discharge valve 12 and charge valve 15 respectively or other type of actuated valves as would be known to one skilled in the art. In the preferred embodiment output signal CC is a two state 0 VDC or 5 VDC that energizes the compressor contactor, which in turn energizes compressor 1, alternatively if compressor 1 is an inverter driven or variable speed compressor output signal CC is 0-10 VDC proportional to the setpoint of the speed of compressor 1.

The text/graphics display driver that in one embodiment has a wired connection to a 256 by 256 pixel LCD display screen or, alternatively, has a connection via standard wireless IEEE 802.11 b/g packet based protocol, or other wireless transmission and reception protocol as would be known to one skilled in the art to a separate or remote display device The measured EER, COP, cooling or heating being delivered and the power consumed is displayed on the wired LCD screen, or on the display of the user's wired or wirelessly connected device, or transmitted by an analog or digital signal, as can any of the other measured, stored, intermediate, output, and/or calculated parameters, as selected using the keypad or wireless touch screen input.

Figure 3:
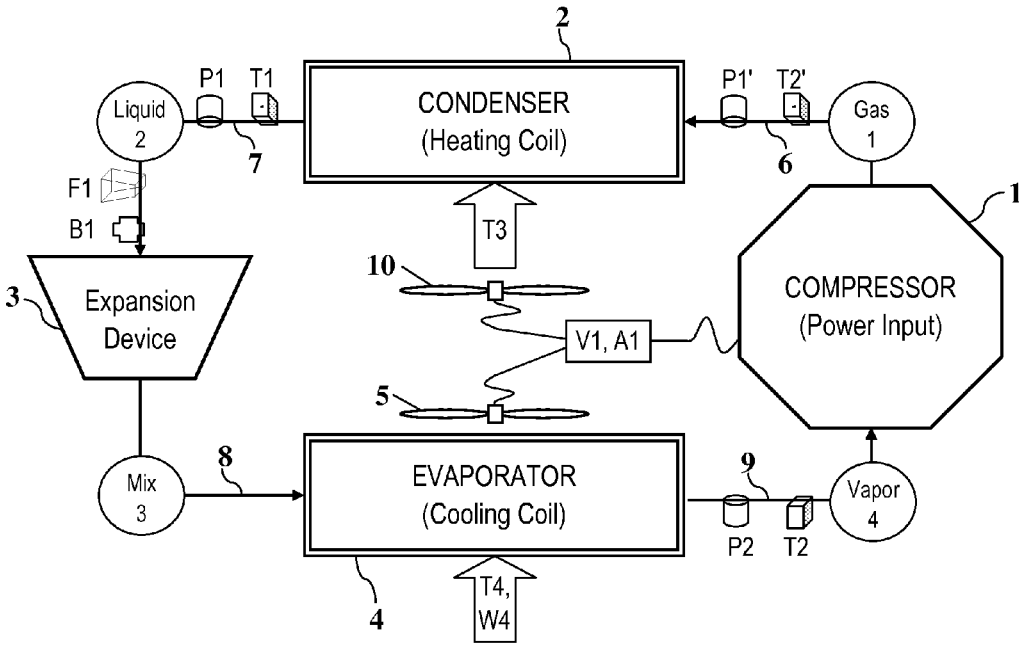
FIG. 3 is a schematic representation of an air conditioner, refrigerator or heat pump showing the primary and secondary components of a basic vapor compression cycle and the preferred positioning of the temperature, pressure, flow, voltage, and current sensors in accordance with the present invention.
Figure 4:
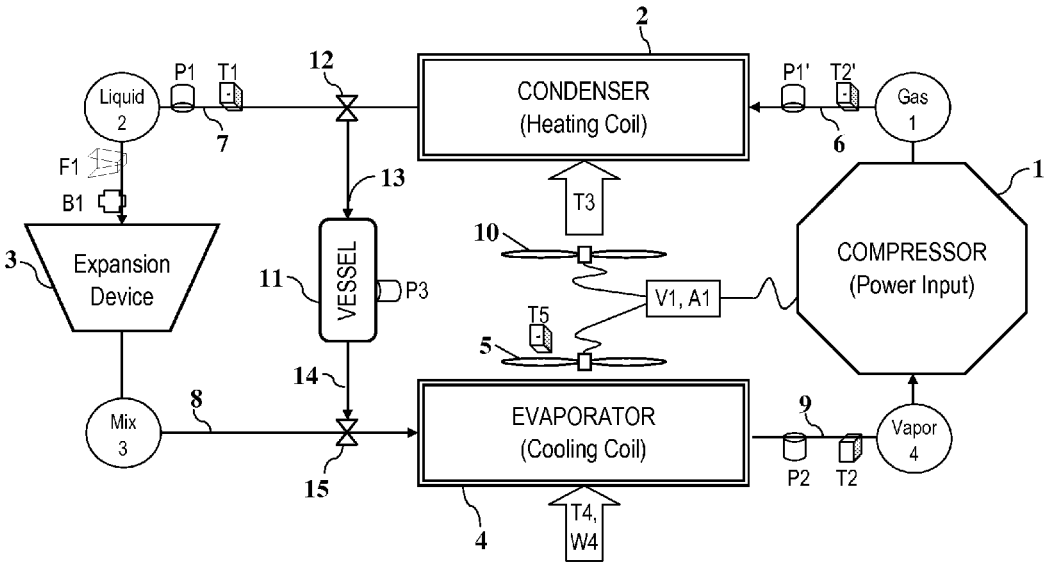
FIG. 4 is a schematic representation of an air conditioner, refrigerator or heat pump showing the primary and secondary components of a vapor compression cycle having a refrigerant reservoir coupled to the circuit via charge and discharge valves; and the preferred positioning of the temperature, pressure, flow, voltage, and current sensors in accordance with the present invention.

A schematic representation of a basic air conditioner, refrigerator or heat pump showing the primary and secondary components of a basic vapor compression cycle and the preferred positioning of the temperature, pressure, flow, voltage, and current sensors is shown in FIG. 3. A schematic representation of an air conditioner, refrigerator or heat pump showing the primary and secondary components of a vapor compression cycle having a refrigerant reservoir coupled to the circuit via charge and discharge valves is shown in FIG. 4. As the differences between the schematic shown in FIG. 3 and that shown in FIG. 4 are only the presence of refrigerant reservoir vessel 11 along with its tubing sections 13 and 14 connecting to control valves 12 and 15, the detailed description herein applies to FIG. 1, FIG. 3 and FIG. 4 using the same component part numbers, and serves to illustrate how the present invention can be similarly applied to various configurations of various components used in air conditioners, refrigerators and heat pumps. Refrigerant working fluid flows in the shown sealed system in a closed circuit in which an hermetically sealed, open-drive, positive displacement, centrifugal or other type of compressor 1, and a condenser heat exchanger coil 2, and an expansion device such as a thermostatic expansion valve, an electronic expansion valve, a fixed orifice, a capillary tube, or other flow control valve 3, and an evaporator heat exchanger coil 4 are arranged. As refrigerant flows through the circuit it changes phase as indicated in the diagram from ① Gas (superheated vapor), to ② liquid, to ③ a mixture of liquid and vapor, to ④ vapor. Refrigerant is made to flow from the closed circuit into refrigerant reservoir vessel 11, which is included in the sealed system, by opening valve 12, which allows refrigerant to flow from tubing 7 into tubing 13. Refrigerant is made to flow into the closed circuit from refrigerant reservoir vessel 11 by opening valve 15, which allows refrigerant to flow from tubing 14 into tubing 8.

Fan, pump, or blower 5 causes the medium that is to be cooled, typically air or water, to flow through or over the evaporator heat exchange coil 4, where flowing liquid refrigerant absorbs the heat from the medium and changes phase from liquid to vapor, and flows into tubing 9 to compressor 1. The temperature of the medium to be cooled is sensed by T4, placed at the inlet of the evaporator coil, and if the medium is air the sensor is a combination temperature relative humidity sensor T4/W4. The temperature of the cooled medium is sensed by T5 placed at the discharge of the air conditioner or refrigerator system. The temperature of the refrigerant vapor in tubing 9 is sensed by T2 for cooling and refrigeration, and by T2' for heating. Sensors T2, T4, and T5 are thermocouples, though resistance temperature detectors (RTD) or other sensors responding to changes in temperature as would be known to one skilled in the art can be used, or T4 is an RTD type concurrent with element W4 thin-film capacitive sensor, though it can be another type of sensor responsive to air relative humidity as would be known to one skilled in the art. In compressor 1 the specific volume of the refrigerant working fluid is reduced thereby increasing its pressure and temperature and the refrigerant is discharged as a superheated vapor or gas into tubing 6 and then to condenser 2. Fan, pump or blower 10 causes the medium that is to be heated, typically air or water, to flow through condenser heat exchange coil 3, where heat is absorbed by the medium from the flowing vapor refrigerant, which changes phase from vapor to liquid, and flows into tubing 7, where its temperature is sensed by T1, and then to expansion device 3. Expansion device 3 can be an orifice, a thermostatic expansion valve (TXV), a capillary tube, an electronic expansion valve (EXV), a flow control valve, an expander, or other type of expansion device as would be known to one skilled in the art. Bubble fraction sensor B1 is optional, and if used it is mounted onto a liquid line sight glass, if needed, to sense the presence of small amounts of vapor if the sight glass is not clear, as would be known to one skilled in the art. The flow rate of liquid refrigerant in tubing 7 is sensed by F1. Non-intrusive external flow sensor F1 is a thermal sensor, though an ultrasonic sensor, or a Doppler transit-time sensor or other sensor responsive to refrigerant mass or volume flow rate or velocity, or an intrusive sensor such as a turbine, vortex, magnetic or other sensor type can be used. The temperature of the medium to be heated is sensed by T3, placed at the inlet of the condenser coil. Sensors T1 and T3 are thermocouples, though resistance temperature detectors (RTD) or other sensors responding to changes in temperature as would be known to one skilled in the art can be used. As refrigerant passes through the expansion device 3 it experiences a pressure loss approximately equal to the increase in pressure driven by compressor 1 minus pressure losses in the tubing and heat exchangers, its temperature is reduced and it flows as a mixture of vapor and liquid into tubing 8, and then to evaporator 4 and the cycle is completed.

FIG. 4 shows application of the invention to a cycle having additional components, illustrated by the addition of refrigerant reservoir vessel 11. In response to controller signal DS, valve 12 is pulsed open to allow a small amount of refrigerant to exist the circuit by flowing from tubing 7 to tubing 13. In response to controller signal CS, valve 15 is pulsed open to allow a small amount of refrigerant to exist the circuit by flowing from tubing 8 to tubing 14, thereby the valves being actuated for reducing/removing or adding/increasing refrigerant charge level. The pressure of liquid refrigerant entering expansion device 3 is sensed by P1, the pressure of vapor refrigerant leaving evaporator coil 4 is sensed by P2, and the pressure of the refrigerant in vessel 11 is sensed by P3. Sensors P1, P2 and P3 are micro-electric mechanical system (MEMS) strain-gauge type having a one piece stainless steel sensing element chemically compatible with refrigerants and refrigerant oils; although other types of pressure sensors with similar characteristics as would be known to one skilled in the art can be used. The voltage and current of the electrical power driving compressor 1 and fans, blowers, and/or pumps 5 and 10 are sensed by V1 and A1, where sensor V1 is directly attached to a line and the neutral or ground power phases conductors, and A1 is a current probe attached around an insulated line power phase conductor as would be known to one skilled in the art.

Figure 5:
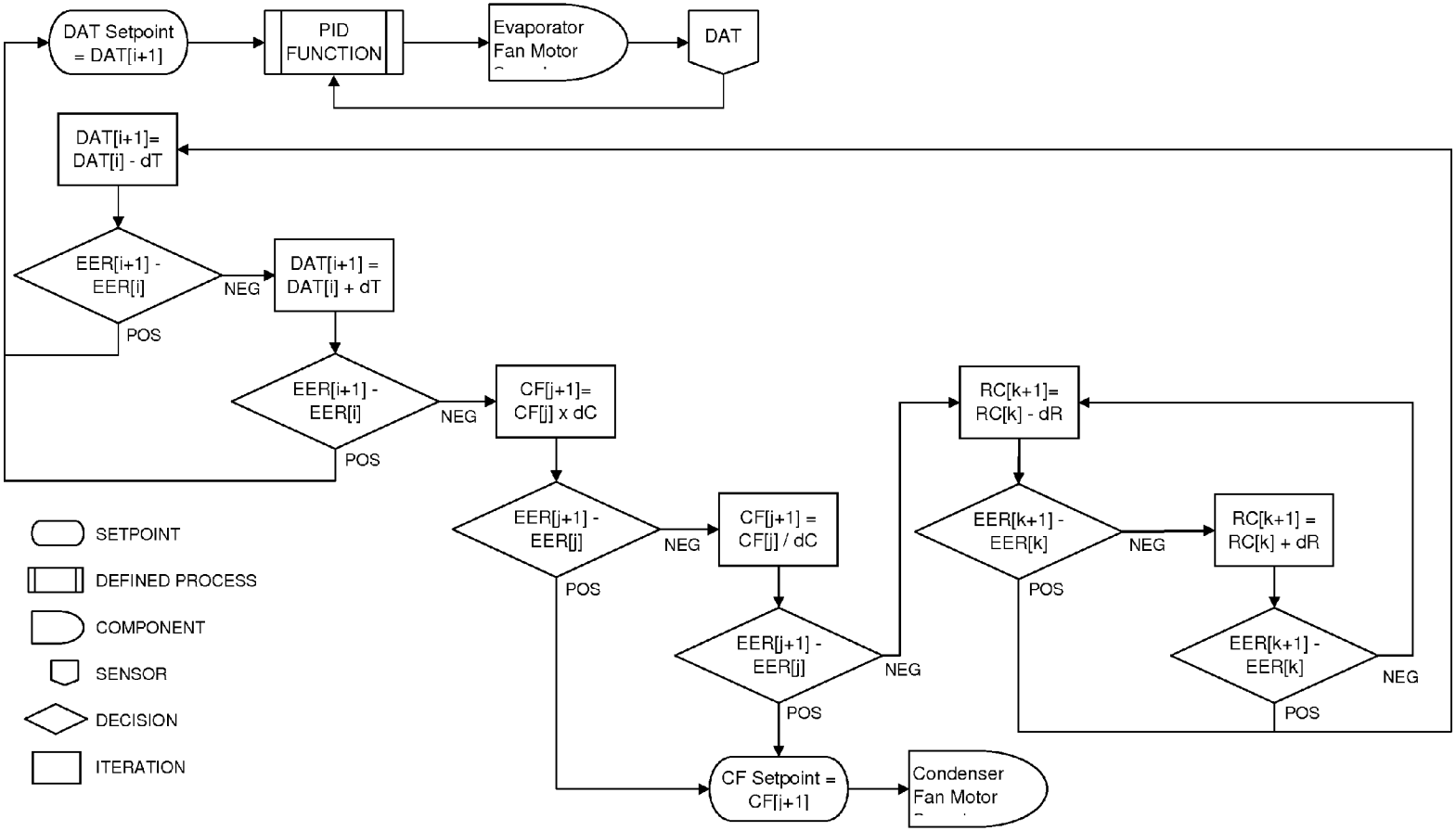
FIG. 5 is a flowchart of the steps of the preferred process for determining the adjustment of the outputs of an embodiment having three operating parameters. EER and COP from data obtained via the sensors and processor and the value of signal outputs that maximize EER are determined in accordance with the present invention.

A flowchart of the steps of the preferred process for determining the adjustment of the outputs of an embodiment having three adjustable operating parameters is shown in FIG. 5, although alternate embodiments with fewer or additional operating parameters operating in cooling or heating modes can be similarly controlled by the present invention. EER and COP from data obtained via the sensors and processor and the value of signal outputs are utilized to maximize EER. An initial DAT set point is provided to a proportional-integral-derivative control function, as would be know to one skilled in the art, which controls fan motor speed so that the discharge air temperature, which is provided as feedback to the PID function, meets the DAT setpoint, and concurrently the EER is measured continuously and stored in memory at pre-defined time intervals. When the DAT has reached a steady-state convergence value, the controller then increments the DAT setpoint by the value dT, which for cooling is determined by comparison of the load SHR, or sensible heat ratio, to the cooling coil SHR. The load SHR is calculated by the ratio of the difference between the evaporator entering temperature T4 and the space temperature setpoint to the difference between the evaporator entering absolute humidity calculated from T4/W4 and space absolute humidity setpoint calculated from the space temperature and humidity setpoints. The cooling coils SHR is calculated by the ratio of the difference between the evaporator entering temperature T4 and the cooling coil saturation temperature, to the difference between the absolute humidity calculated from T4/W4 and the saturated absolute humidity at the cooling coil saturation temperature, which is calculated from T2 and P2 using formulas as would be known to one skilled in the art. DAT increment dT is negative if the load SHR is less than the cooling coil SHR and positive if the cooling coil SHR is less than the load SHR. When the system has restabilized, either after a pre-defined stabilization period or after the DAT and EER have reached convergence values, the EER is compared relative to the EER prior to the increment of DAT setpoint and if the EER has increased the control loop proceeds to the next operating parameter to be iterated. If the EER has decreased, the sign of dT is changed, from positive to negative or negative to positive, and EER is again compared after the system restabilizes. The controller then proceeds to the next operating parameter, and increments the CF setpoint by the value dC, which is determined by comparison of the refrigerant liquid subcooling and the condenser temperature split against stored values. The refrigerant liquid subcooling is the temperature difference between the saturated liquid temperature calculated from P1 and T1, and the liquid temperature T1 using formulas as would be known to one skilled in the art, and the condenser temperature split is the difference between the saturated liquid temperature and air temperature T3. CF increment dC is less than 1 if the liquid subcooling or the condenser split are below stored values, and greater than 1 if either are above stored values. When the system has restabilized, either after a pre-defined stabilization period or after the EER has reached a pre-defined convergence value, the EER is compared relative to the EER prior to the increment of CF setpoint and if the EER has increased the control loop proceeds to the next operating parameter to be iterated. If the EER has decreased, dC is changed, from greater than 1 to less than 1 or from less than 1 to greater than 1, and EER is again compared after the system restabilizes. If the air conditioner, refrigerator or heat pump has refrigerant charge adjustment valves, the controller then increments the RC setpoint by the value dR, or if there are no further adjustments the control loop returns to initiate another DAT increment. The RC setpoint dR is determined by comparison of the refrigerant liquid subcooling and the condenser temperature split against stored values. RC increment dC is negative if the liquid subcooling or the condenser split are below stored values, and positive if either are above stored values. When the system has restabilized, either after a pre-defined stabilization period or after the EER has reached a pre-defined convergence value, the EER is compared relative to the EER prior to the increment of RC setpoint and if the EER has increased the control loop proceeds to the next operating parameter to be iterated. If the EER has decreased, the sign of dC is changed, from positive to negative or negative to positive, and EER is again compared after the system restabilizes. If there are additional operating parameter adjustments, such as refrigerant composition, damper position, compressor speed, and/or others as would be known to one skilled in the art, the iteration sequence is continued until all operating parameters have been adjusted to achieve the maximum EER, and the control loop repeats with the first operating parameter. In this way, the maximum EER is continuously achieved by incrementally adjusting each operating parameter to realize an incremental increase in EER, even as conditions such as ambient temperature are changing.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

What is claimed is:

1. A system for maximizing the energy efficiency ratio or coefficient of performance of an air conditioner or a heat pump comprising:

a first pressure sensor adapted to measure a first refrigerant pressure selectively at a condenser outlet or a condenser inlet and to generate a first pressure signal indicative of the first refrigerant pressure;

a first temperature sensor adapted to measure a first refrigerant temperature at an evaporator outlet and to generate a first temperature signal indicative of the first refrigerant temperature;

a second pressure sensor adapted to measure a second refrigerant pressure at the evaporator outlet or a compressor inlet and to generate a second pressure signal indicative of the second refrigerant pressure;

a second temperature sensor adapted to measure a second refrigerant temperature selectively at a condenser outlet and to generate a second temperature signal indicative of the second refrigerant temperature;

a flow sensor adapted to measure a refrigerant flow rate and to generate a flow signal indicative of the refrigerant flow rate;

a power voltage sensor configured to measure an electrical voltage input to the air conditioner or the heat pump and generate a power voltage signal proportional to the electrical voltage input;

a power current sensor configured to measure an electrical current input to the air conditioner or the heat pump and to generate a power current signal proportional to the electrical current input; and a processor in electrical communication with the first pressure sensor, the first temperature sensor, the second pressure sensor, the second temperature sensor, the flow sensor, the power voltage sensor, and the power current sensor, wherein the processor is adapted to receive the first pressure signal, the first temperature signal, the second pressure signal, the second temperature signal, the flow signal, the power voltage signal, and the power current signal;

wherein the processor is configured to calculate a first enthalpy based on the first pressure signal;

wherein the processor is configured to calculate a second enthalpy based on the second pressure signal;

wherein the processor is configured to calculate a measured energy efficiency ratio or a coefficient of performance as the difference between the first enthalpy the second enthalpy divided by a value proportional to the power voltage signal or the power current signal;

wherein the processor is configured to provide an evaporator fan motor speed control signal to an evaporator fan motor;

wherein the processor is configured to provide a condenser fan motor speed control signal to a condenser fan motor;

wherein the processor is configured to provide a compressor control signal to a compressor; and wherein the processor is configured to adjust the value of one or more of the evaporator fan motor speed control signal, condenser fan motor speed control signal, or compressor control signal based on the calculated measured energy efficiency ratio or coefficient of performance.

2. The system according to claim 1 wherein the first temperature signal of the first temperature sensor has an amplitude proportional to a first refrigerant temperature;

wherein the second pressure signal of the second temperature sensor has an amplitude proportional to a second refrigerant temperature;

wherein the first pressure signal of the first pressure sensor has an amplitude proportional to the first refrigerant pressure; and wherein the second pressure signal of the second pressure sensor has an amplitude proportional to the second refrigerant pressure.

3. The system according to claim 1 wherein the flow sensor is disposed onto a refrigerant conduit and the flow signal has an amplitude proportional to the refrigerant flow rate.

4. The system according to claim 1 wherein the power voltage sensor and the power current sensor are disposed onto an electrical power supply of the air conditioner or the heat pump;

wherein the power voltage signal has an amplitude proportional to the electrical voltage input; and wherein the power current signal has an amplitude proportional to the electrical current input.

5. The system according to claim 1 further comprising a third temperature sensor adapted to measure a first air temperature through a condenser and to generate a third temperature signal indicative of the first air temperature and having an amplitude proportional to the third temperature.

6. The system according to claim 1 wherein the processor is further configured to successively increment at least one of the evaporator fan motor speed control signal, condenser fan motor speed control signal, or compressor speed control signal, evaluate the resulting change in the measured energy efficiency ratio or coefficient of performance, and determine a next incremented output signal value for the evaporator fan motor speed control signal, condenser fan motor speed control signal, or compressor speed control signal to increase the value of the calculated measured energy efficiency ratio or coefficient of performance.

7. The system according to claim 1 further comprising:

a first valve adapted to control a first refrigerant flow through an inlet of a vessel adapted to store a refrigerant, wherein the first valve is in electrical communication with the processor and the processor is configured to provide a first voltage output signal to the first valve; and a second valve adapted to control a second refrigerant flow through an outlet of the vessel, wherein the second valve is in electrical communication with the processor and the processor is configured to provide a second voltage output signal to the second valve.

8. The system according to claim 1 further comprising:

a fourth temperature sensor in electrical communication with the processor and adapted to measure a second air temperature through an evaporator and to generate a fourth temperature signal indicative of the second air temperature and having an amplitude proportional to the fourth temperature;

a fifth temperature sensor in electrical communication with the processor and adapted to measure a third temperature at an inlet of the evaporator and to generate a fifth temperature signal indicative of a third air temperature and having an amplitude proportional to the fifth temperature; and a humidity sensor in electrical communication with the processor and adapted to measure a humidity level at the inlet of the evaporator and to generate a humidity signal indicative of the humidity level and having an amplitude proportional to the humidity level.

* * * * *